US005354170A

United States Patent [19]

Schweingruber et al.

[11] Patent Number: 5,354,170

[45] Date of Patent: Oct. 11, 1994

[54] STACKING AND TURNING DEVICE FOR A MACHINE PRODUCING PACKAGING BOX BLANKS

[75] Inventors: Hermann Schweingruber, Sullens; Emile Gut, Crissier, both of Switzerland

[73] Assignee: Bobst S.A., Lausanne, Switzerland

[21] Appl. No.: 881,646

[22] Filed: May 12, 1992

[30] Foreign Application Priority Data

May 14, 1991 [CH] Switzerland ..... 01428/91-2

[51] Int. Cl.[5] ..... B65G 57/00

[52] U.S. Cl. ..... 414/790; 414/790.2; 414/790.3; 414/790.4; 414/907

[58] Field of Search ..... 414/790, 790.2, 790.3, 414/790.4, 907, 225

[56] References Cited

U.S. PATENT DOCUMENTS

| | | | |
|---|---|---|---|
| 1,676,911 | 7/1928 | McDavitt | 414/790.4 |
| 1,693,632 | 12/1928 | Zuckerman | 414/790 |
| 2,761,361 | 9/1956 | Hornberger et al. | 414/790.4 |
| 2,776,831 | 1/1957 | Shields | 414/790.3 |
| 3,374,902 | 3/1968 | Mills | 414/790 X |
| 3,675,792 | 7/1972 | Griner et al. | 414/790.4 X |
| 4,367,997 | 1/1983 | Schweingruber | 414/789.2 |
| 4,474,521 | 10/1984 | Jaton | 414/788.3 |
| 4,784,558 | 11/1988 | Toriyama | 414/790.3 X |
| 4,850,781 | 7/1989 | DeBin et al. | 414/790.4 X |

FOREIGN PATENT DOCUMENTS

| | | |
|---|---|---|
| 2521965 | 8/1983 | France . |
| 2621024 | 3/1989 | France . |

*Primary Examiner*—Cheryl L. Gastineau
*Attorney, Agent, or Firm*—Hill, Steadman & Simpson

[57] ABSTRACT

A device for building up a stack of perfectly aligned packing box blanks and turning the stack consists of four movable stores angularly arranged on a rotary support for movement between four succeeding stations. The rotary support effects a 90° stop-and-go rotation. In the first station, the stack is built-up with blanks provided by a first conveyor; in the second station, the stack is subjected to an aligning action on its side due to a 90° rotation of the store; and in the third station the stack of blanks is, again, in a flat position but inversed with regard to the position of the first station to be removed by a second conveyor.

4 Claims, 6 Drawing Sheets

STACKING AND TURNING DEVICE FOR A MACHINE PRODUCING PACKAGING BOX BLANKS

BACKGROUND OF THE INVENTION

The present invention is directed to a blank stacking and turning device which is to be added to the outlet of a so-called printing/cutting machine producing packaging boxes.

U.S. Pat. No. 4,367,997, whose disclosure is incorporated herein by reference thereto and which claims priority from the Swiss Application which issued as Swiss Patent 633 761, discloses a device for piling blanks coming out of a printing/cutting machine in the form of three parallel streams, which are carried by a belt conveyor. Each of the streams is built up into a separate stack or pile. At the horizontal end of the conveyor, the blanks drop one by one into a table-shaped storage device, which is movable vertical in such a way as to keep the upper surface of the three side-by-side stacks at a constant height. Appropriate means are provided to stop the blank supply each time the expected pile height is obtained.

Once the pile height is obtained, the table is lowered to the level of a second crosswise conveyor extending perpendicular to the first conveyor and a pusher simultaneously shifts the three piles onto the second conveyor. The pusher is then moved backward, whereupon the table is set back to its initial height, at which piling or stacking is resumed. The build-up of new piles may then begin, while the three previously-formed piles or stacks are transferred crosswise one-by-one onto a second table on which the piles are shifted in a direction parallel to the first conveyor.

However, in view of the present steadily-increasing production speeds rising to, say, 3,000 boxes per minute, the time for forming a pile of approximately 250 box blanks per pile is approximately 5 seconds for each of the three streams. It is quite obvious that there is no possibility to proceed to consecutively shift both the table and the pusher in a sufficiently short period of time, which is still compatible with such production speeds. Moreover, since, for the future handling of the piles, for instance palletizing, the sides of these piles formed by the edges of the blanks are to be properly aligned or adjusted, these piles will have to be effectively rotated through 90° during a transfer movement from the second to the third conveyor so that they will rest on the edges of the blanks forming the pile, thereby assuring the alignment or adjustment. The alignment of the other edges perpendicular to the first edges is achieved by means of joggers fitted on bars used for properly arranging the piles on the second table. The piles will then be collected either manually or automatically from the third table consisting essentially of belts, for instance, with a view toward palletizing.

However, such a device for aligning the pile sides has the following drawbacks. With high production speeds, it is difficult to obtain a crosswise shifting and subsequent 90° rotation of the three piles successively in the course of the period of 5 seconds; it significantly increases the lengthwise encumbering of the machine; and, at the end of the alignment, the piles rest with the blank edges on a table which requires another pile rotation through 90° to a second position so as to turn the printed side of the blanks downward. This second position corresponds to the one necessary for the subsequent infeed of the blanks into a so-called folding box gluing machine and, thus, to the one for their palletization.

For feeding the folding box gluing machine, a known method consists of putting previously-prepared piles into a turning device which enables turning the piles through 180° so that a pile which was formed with the print facing upward can then be turned so that the print is facing downward. However, these have the sole purpose of turning and not stacking or aligning of the blanks in the piles.

SUMMARY OF THE INVENTION

It is an object of the present invention to enable a realization of stacking devices without the above-mentioned drawbacks. For example a compact device adapted to the present high production speeds and additionally capable of turning the blanks.

These objects are obtained in a blank stacking and turning device for a so-called printing and cutting machine producing packaging boxes, said device comprising means forming a closed circuit situated in a vertical plane, a plurality of movable stores, each being capable of containing one stack of blanks and being arranged on said means forming the closed circuit, a plurality of fixed stations arranged at regular distances along the path of the closed circuit and comprising sequentially at least a first station for forming stacks in one of the stores, a second station for aligning the stacks and a third station for removing the stacks from the store, and means for achieving a simultaneous transfer of all the stores from one station to the other so that, in the course of said transfer, every stack will carry out a revolution through approximately 90° around an essentially horizontal axis and that in this way, beginning with the essential flat position of the blanks within the first station, the stack in the second station will rest on the edges of the blanks forming the stack or pile, and that in the third station the blanks will be in a flat position, though turned with regard to the position of the first station.

The invention also includes forming the device as a cassette, which is received in a larger device so that when the size of the blanks is being changed, a new cassette can be inserted for stacking, aligning and turning the stacks.

Other advantages and features of the invention will be readily apparent from the following description of the preferred embodiments, the drawings and claims.

DESCRIPTION OF THE PREFERRED EMBODIMENTS

Figure 1:
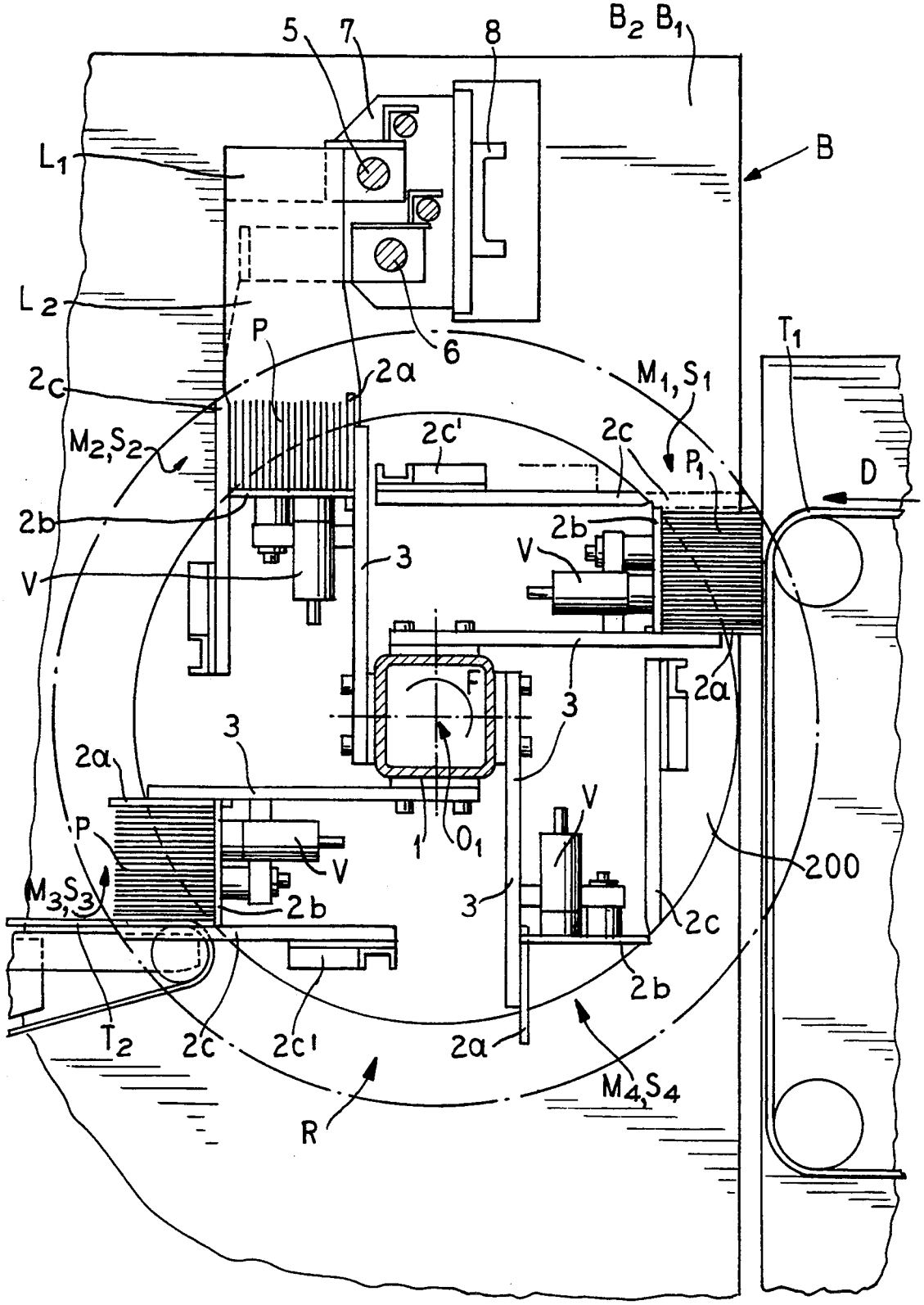
FIG. 1 is a vertical cross sectional view with portions in elevation of a stacking and turning device according to the present invention.

The principles of the present invention are particularly useful when incorporated in a stacking and turning device comprising a frame B consisting of two lateral walls $B_1$ and $B_2$ (see FIG. 2), which are connected to one another by profiled pieces or members 8, as best illustrated in FIG. 1. A rotary support, generally indicated at R, consists of a central square-shaped profiled piece or member 1, which is supported for rotation in the frame B on an axis $O_1$. The square-shaped member or piece 1 on each of its four sides supports four radial extending supports 3, which are arranged to extend and form angles of 90° from one another and are fixed to rotate with the piece 1 in the frame B. The rotational axis $O_1$ for the rotary support R is identical with the one for the profiled piece 1 and is situated to extend perpendicular to the operating direction of a conveyor $T_1$ which delivers the blanks D, for instance in the form of three streams. The conveyor $T_1$ is actually a belt insuring the acceleration of the streams. Pile and delivery stores $M_1$ through $M_4$ are provided at each free end of the four radial supports 3. The stores $M_1$ to $M_4$ are situated at a regular distance from the axis $O_1$ and describe a closed circular track or circuit during the rotation of the support R. If viewed crosswise or perpendicular to the axis $O_1$, each store $M_1$ to $M_1$ consists of a first wall 2*a* fitted on a radial support 3, a second wall 2*b* adjacent and extending perpendicular to the first wall 2*a*, and a third movable wall 2*c* which is positioned opposite the first wall 2*a* and shiftable between two positions, with the retractable position being shown for the stores $M_1$ and $M_4$ and the extended position being shown for the stores $M_2$ and $M_3$.

Figure 3:
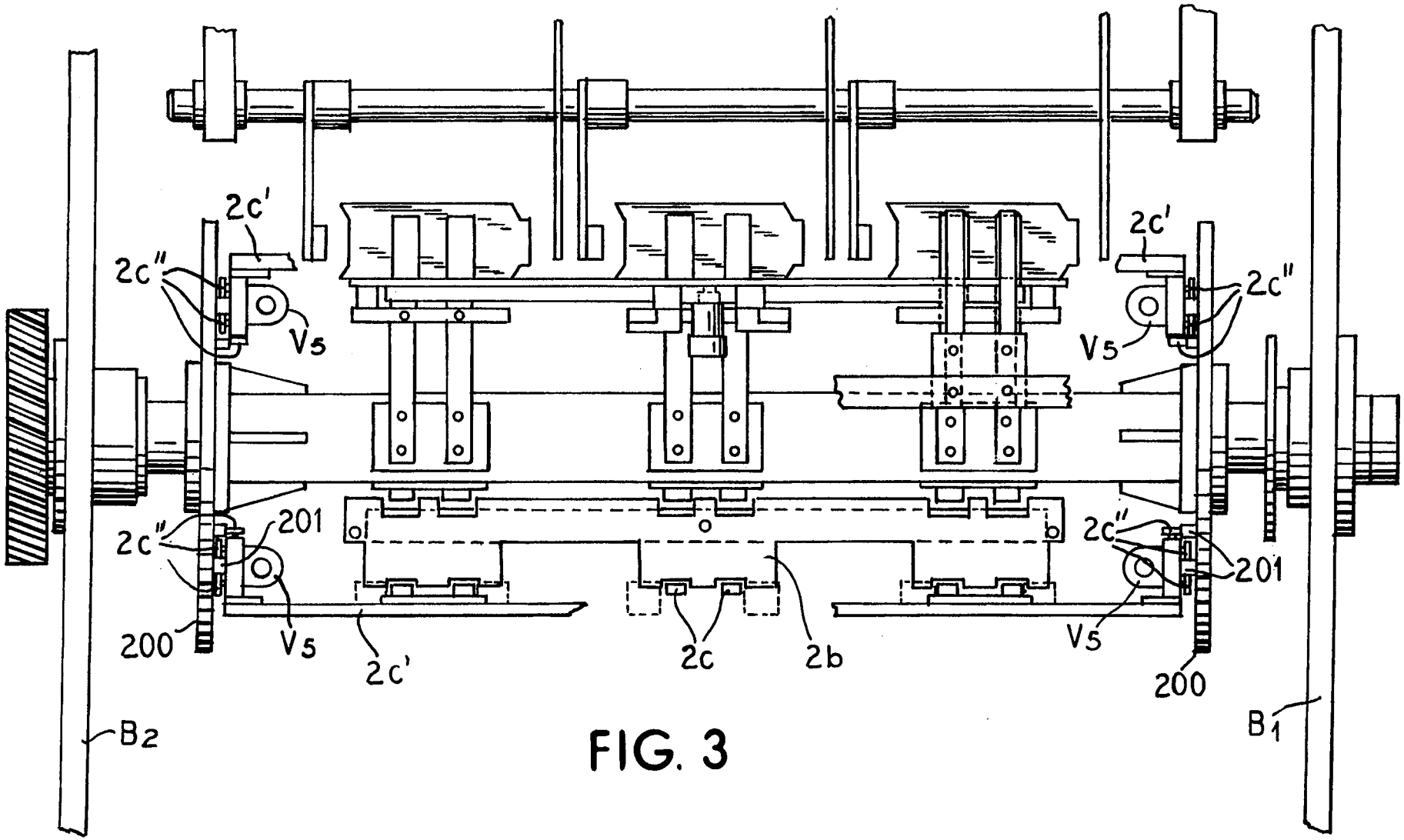
FIG. 3 is a complete end view with portions removed for purposes of illustration taken from the left-hand side of FIG. 1.

The third wall 2*c*, as best illustrated in FIG. 3, is in the form of a fork consisting of several profiled pieces mounted on a cross member 2*c*'. The member 2*c*' is supported at each end by rollers 2*c*'', which are engaged on corresponding rails 201, which are mounted on cylindrical plates 200. The plates 200 are able to rotate together with the central profiled piece 1. Jacks $V_5$ are mounted on each of the plates 200 for shifting the fork-shaped walls 2*c* between the retracted position and extended or advanced position.

Referring to FIG. 1, the device includes four work stations $S_1$ to $S_4$, which are equally arranged at regular distances through the 360° circle. The rotary support R is in its stationary position in which the first wall 2*a* of the first store $M_1$ is situated at a first so-called stacking station $S_1$, which is horizontally positioned and situated underneath the horizontal end of the conveyor $T_1$. The second wall 2*b* is oriented upward, whereas the third wall 2*c* is situated in a first or retracted position, which is shown in continuous lines for the first station $S_1$ and is situated outside the space contained between the second wall 2*b* and the conveyor $T_1$. In this first position, the blanks D, when reaching the end of the horizontal track of the conveyor $T_1$, will drop flat onto the first store $M_1$ to build up stacks or piles $P_1$. For simplifying the description, only one of the stacks $P_1$ will be herein mentioned.

As soon as the stack $P_1$ has obtained the regular required height, the supply of blanks D is stopped. At this stage, the third wall 2*c* is shifted horizontally to the right-hand side to the extended position to extend over the stack as shown by chain lines. As soon as the stack $P_1$ has obtained the required height, the support is then carried or rotated through a 90° rotation in the direction of the arrow F in order to insure the transfer of every store $M_1$ through $M_4$ from station-to-station. FIG. 1 shows that with the transfer occurring from the first station $S_1$ to the second so-called aligning station $S_2$, the stack will effect a half-turn, which is to say that the stack $P_1$ is rotated through 90° to a position assumed by the stack in station $S_2$ so that the stack will rest on the edges of the blanks forming the stack, wherein the two walls 2*a* and 2*c* will hold the stack or pile in this vertical orientation.

In the second station $S_2$, vertical alignment is achieved by vibrating the second or lower wall 2*b* by means of a pneumatic vibrator V. The alignment of the two opposite vertical sides or edges formed by the edges of the blanks D is achieved by means of two movable lateral joggers $L_1$ and $L_2$, which have the shape of vertical plates, shown by the plates $L_1$ and $L_2$ in FIG. 1.

Figure 2:
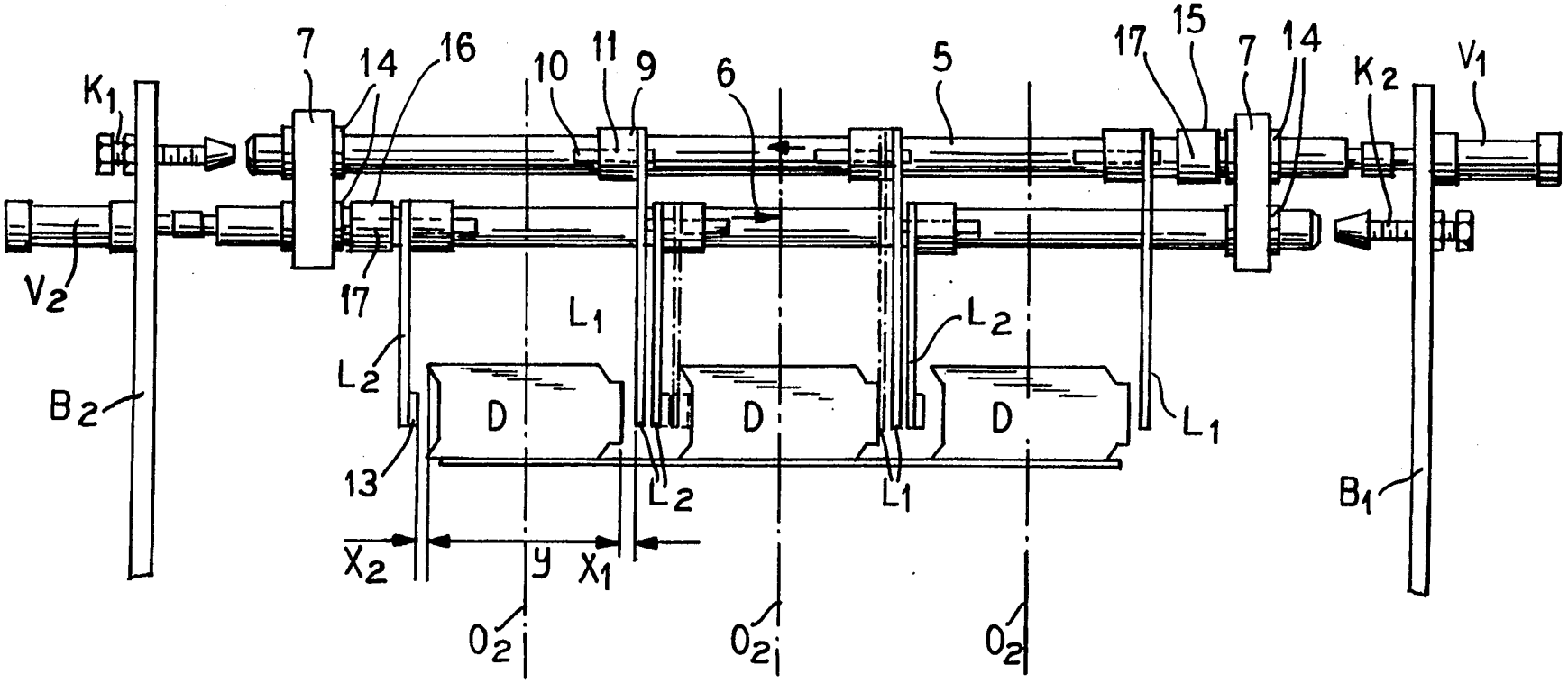
FIG. 2 is a partial end view taken from the left-hand side of FIG. 1.

The lateral joggers $L_1$ and $L_2$ are mounted so as to be horizontally shiftable along crossbars 5 and 6 (see FIGS. 1 and 2). As illustrated in FIG. 2, all of the joggers $L_1$ destined to insure the alignment of the right-hand edges are fitted on the upper bar 5, and all the joggers $L_2$ which are destined to insure the alignment of the left-hand edges are fitted on the bar 6. The two movable bars 5 and 6 are connected at their two ends by means of flanges 7 to a crosswise profiled piece (see FIG. 1 ), which crossbar is connected at its two ends to the lateral members $B_1$ and $B_2$ of the frame B.

Between each of the flanges 7 and the bars 5 and 6, a ball bushing 14 is positioned in such a way as to enable the crosswise shifting of the bars 5 and 6 with the shifting motion being caused by the jack $V_1$ for the bar 5 and $V_2$ for the bar 6. As illustrated, the jacks are attached at one end of each of the respective bars, and the other end will engage a threaded stop $K_1$ and $K_2$, respectively, which will enable setting the amount of shifting.

The bar 5 has a bushing 15, and the bar 6 has a bushing 16, which bushings are provided with interlocking screws 17 to act as a switch protecting the installation against jams likely to occur during rotation. Each of the joggers $L_1$ and $L_2$ is connected for joint rotation with the bars 5 and 6, respectively, by means of a bushing 9 and a component 10 having the shape of a cotter, itself connected with the bushing 9 by means of an interlocking screw 11. The cotter 10 is able to slide along the plane surface corresponding to the bars 5 or 6. Owing to the rotation of the screw 11, it is possible to push the cotter 10 firmly against the bar 5 or 6 to call forth between the two elements 5 or 6 and 10 a frictional force insuring the positioning of the jogger $L_1$ or $L_2$ along each of the respective bars 5 and 6.

The individual position of the joggers $L_1$ and $L_2$ on the bars 5 and 6, respectively, is determined in accordance with the position and the crosswise measurements of the blanks D. In reality, and for carrying out this operation more easily, each blank D is expected to always be centered on one of the reference lines or planes $O_2$, which are regularly arranged at axial spaced positions on the bars 5 and 6. Depending on the blank length y, each of the right-hand joggers $L_1$ is positioned from a plane $O_2$ at a distance equal to $y/2+x_1$, wherein y is the axial measurement for the blank D and $x_1$ is a slight additional distance. In a similar way, every left-hand jogger $L_2$ is positioned at a distance $y/2+x_2$ with regard to the plane $O_2$. In this case, where one of the edges, for example the left-hand edge of the blank D has a hollow or recessed shape, as shown in FIG. 2, it would be possible to fix on the jogger $L_2$ a compensation piece 13 having a thickness of which would be equal to the depth of the hollow or recessed portion. With all joggers $L_1$ and $L_2$, thus, positioned, the three right-hand joggers $L_1$ will move simultaneously through a distance $x_1$ to the left-hand side, owing to the corresponding shift of the bar 5 by the jack $V_1$. In a similar manner, the left-hand joggers $L_2$ are also shifted by the jack $V_2$ through a distance $x_2$ toward the right-hand side. As shown by dotted lines for the blank situated in the center of FIG. 2, the joggers $L_1$ and $L_2$ are situated in a position in which the edges of the corresponding stack will have been aligned. Then, the jacks $V_1$ and $V_2$ are actuated in a reverse direction so as to have the joggers $L_1$ and $L_2$ pulled back to their initial position, thereby enabling the removal of the stack in that station and the next following stacks to arrive in the second station.

In the third station $S_3$, the stacks or piles P have been turned so as to have the printed side of the blanks D directed downward. The assembly is, thus, conceived so that the fork-shaped elements of the third movable wall 2*c* extend horizontally between and slightly lower than the belts of a second conveyor $T_2$, which is designed to remove the stacks or piles P from the stacking and turning device. The stack P will then rest with its lowermost plank on the conveyor $T_2$, and the conveyor $T_2$ is driven stepwise and timed with the stop-and-go rotation of the rotary support R.

In the fourth station $S_4$, the store $M_4$ is empty and in a standby position with the third wall 2*c* being in the retracted position, as shown in FIG. 1.

In order to provide sufficient precision with each quarter turn involved with the stop-and-go rotation of the support R, the central profiled piece 1 is driven by a motor M (see FIG. 4) connected to a precision indexing mechanism $I_1$. This mechanism operates with the control of a globoid cam and enables the rotary motion of the outlet shaft of the motor M to be convened into a stop-and-go rotary motion for the profiled piece 1.

The fixture, as well as the way of making the three walls 2*a*, 2*b* and 2*c* of every store $M_1$ to $M_4$ are conceived in such a way that the measurements of the latter stores can be adapted to the various box sizes likely to be processed within the machine.

In addition, the adaptation of the stores $M_1$ to $M_4$ to the desired height of the stack P can be achieved by varying the thickness of the first wall 2*a*.

Figure 4:
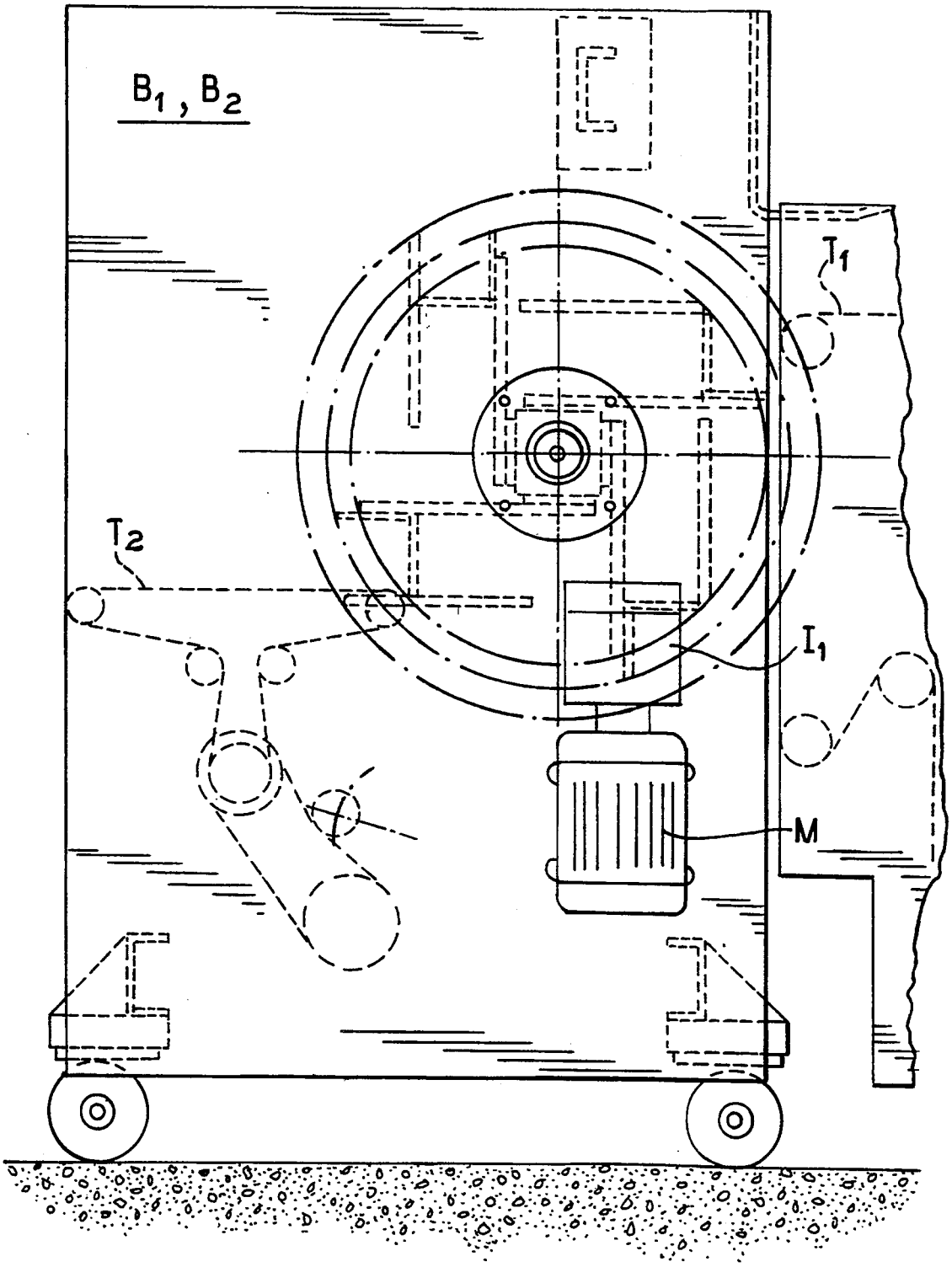
FIG. 4 is a side view of the device of FIG. 1.

The frame B can be fitted on wheels, as illustrated in FIG. 4, to allow an easy installation and removal of the stacking and turning device with regard to the first conveyor $T_1$.

As may be gathered from the above description, the stacking and turning device according to the present invention enables a very high production speed, since the duration of the stack transfer is actually reduced to the time required for a simple quarter turn of 90° of the rotary support R. The device allows production of aligned and turned stacks P within a reduced space, i.e., without considerably increasing the lengthwise space requirement of the package production machine. The device also allows elimination of jam hazards caused by the conventional lateral joggers.

Figure 5:
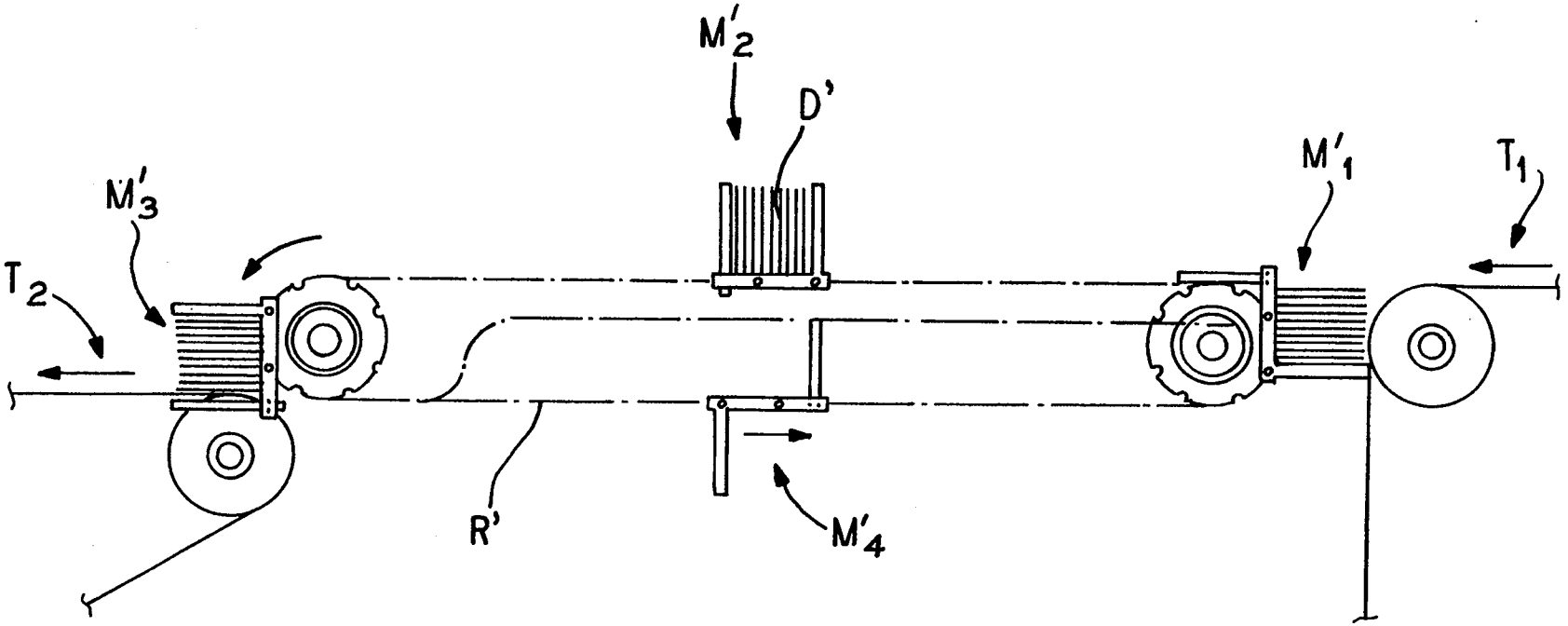
FIG. 5 is a schematic illustration of an embodiment of the device for handling larger sized stacks.

When processing large-sized blanks D′ (see FIG. 5) involving difficulties on account of their space requirements with the fitting of the stores $M'_1$ to $M'_4$ of corresponding measurements of a single rotary support R, the lateral support can be replaced by a chain set R′ describing a closed circuit by means of idling wheels. The stores $M'_1$ to $M'_4$ are arranged at regular distances along the chains R′ and travel successively through various work stations $S'_1$ to $S'_4$ similar to the way adapted by the first embodiment of realization of the device.

Figure 6:
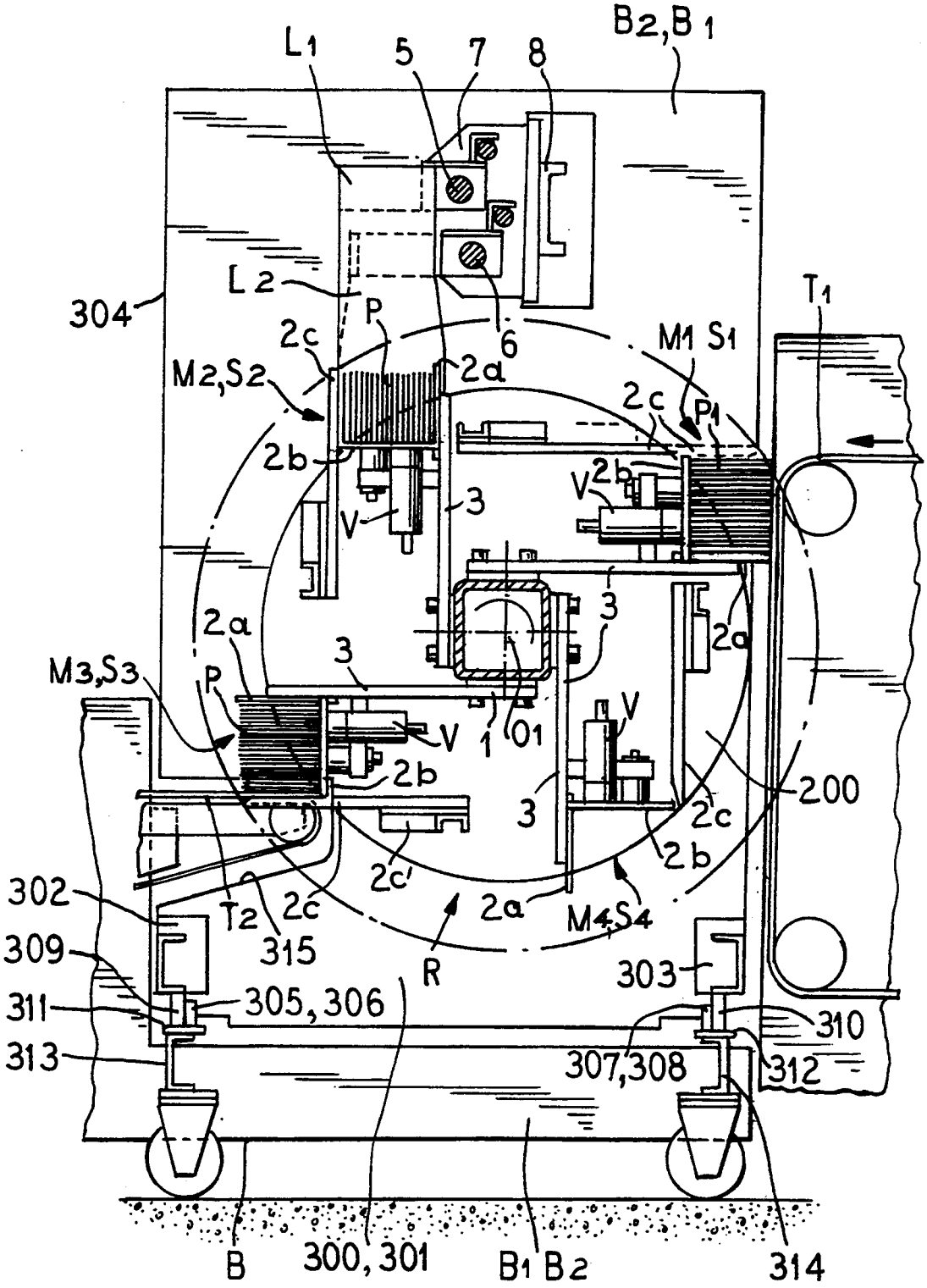
FIG. 6 is a vertical cross sectional view similar to FIG. 1 of a stacking and turning device constructed in a cassette-type support.

The stacking and turning device represented by FIG. 6 is with all features similar to the one described with reference to FIG. 1. However, in order to render even easier the size changes as required with this kind of apparatus, it is foreseen to arrange the components of the stacking and turning device between two side walls 300 and 301 connected to one another by braces 302 and 303 so as to form a removable cassette 304 allowing the withdrawal sidewise from the stacking and turning device of the machine. To this aim, the removable cassette 304 is equipped, on its lower part, with four rollers 305–308, which are mounted on crossbars 309 and 310, which are fitted on the braces 302 and 303.

The rollers 305–308 travel on two tracks 311 and 312, which are mounted on small beams 313 and 314, which connect the two side walls $B_1$ and $B_2$ of the stacking and turning device. A centering and locking device (not represented) is provided so that the removable cassette 304 is held in position within the stacking and turning device. With this execution, the drive means of the device are interdependent though permanently connected with one of the side walls 300, 301 of the removable cassette 304. The side walls 300 and 301 are provided with a recess 315 which enables the withdrawal and removal of the cassette 304 from the stacking and turning device without necessitating the removal of the belt $T_2$ of the conveyor provided for removing the pile of blanks. For enabling the removal of the cassette 304, it will be necessary to have the stack stores $M_1$ to $M_4$ turn through an angle of approximately 30° from the position illustrated.

This execution adds various benefits to the stacking and turning device and, particularly, allows a setting of all the components of a second stacking and turning device away from the machine, as required by a new job. Then, by a simple replacement of the cassette used for a previous job, a maximum reduction of the downtime occurring between two different jobs is obtained.

Although various minor modifications may be suggested by those versed in the art, it should be understood that we wish to embody within the scope of the patent granted hereon all such modifications as reasonably and properly come within the scope of our contribution to the art.

We claim:

1. A blank stacking and turning device for a printing-/cutting machine producing packaging boxes, said device comprising a frame consisting of two lateral members connected to one another by profiled pieces; means for forming a closed circuit situated in a vertical plane, said means including a circular rotary support being mounted in said frame; four movable stores being capable of containing one stack of blanks being arranged at 90° on the periphery of the support of the means for forming a closed circuit; four fixed stations being arranged at regular distances around the rotary support to be aligned with the four stores with the support in a stopped position, said fixed stations including a first station for forming a stack in a store positioned at said first station, a second station for aligning blanks in a stack, a third station for removing the stack from the store and fourth station being a standby stations with no stacks in the corresponding store; and means for achieving a simultaneous transfer of all stores from one station to the next following station and including indexing means for controlling a 90° stop-and-go rotation of the support in order to insure the transfer of stores between stations so that in the course of said transfer between adjacent stations, every stack will carry out a revolution through approximately 90° around an essentially horizontal axis and that in this way, beginning with the essentially flat position of the blanks within the first station, the stack, when in the second station, will rest on the edges of the blanks in the store, and in the third station the blanks will be in a flat position that will be turned 180° with regard to the position of the blanks in the first station.

2. A device according to claim 1, wherein said frame of two lateral members forms a cassette having rollers received on a lateral track, said lateral tracks being mounted on beams extending between two outer frame members so that the cassette can be removed from the main frame.

3. A device according to claim 1, wherein each of the stores includes a first wall, a second wall adjacent and extending perpendicular to the first wall, and a third wall formed by retractable fork-shaped members movable between a retracted position and an extended position, said fork-shaped members extending perpendicular to the second wall and parallel to the first wall so that when in the first station, the third wall is in a retracted position to allow the formation of a stack of blanks on the first wall, said third wall being shifted to the extended position after completion of the formation of the stack so that when the store is shifted to the second station, the stack of blanks will rest on lower edges of the blanks between the first and third walls, which hold the blanks extending in a vertical plane, and in the third station, the third wall is situated beneath and between the belts of a conveyor for removing the stack with the blanks resting on said conveyor.

4. A device according to claim 3, wherein in the second station, alignment is achieved by means of pneumatic vibrators acting on the second wall, and by two lateral joggers movable so as to come into contact with vertical edges of the blanks.

* * * * *